US005818161A

United States Patent [19]

Park

[11] Patent Number: 5,818,161

[45] Date of Patent: Oct. 6, 1998

[54] ELECTRON GUN CATHODE HOLDER WITH MANUFACTURING HOLES

[75] Inventor: Young-Kook Park, Kyungki-do, Rep. of Korea

[73] Assignee: Samsung Display Devices Co., Ltd., Kyungki-do, Rep. of Korea

[21] Appl. No.: 665,482

[22] Filed: Jun. 18, 1996

[30] Foreign Application Priority Data

Jun. 21, 1995 [KR] Rep. of Korea ..... 95-14158

[51] Int. Cl.[6] ..... H01J 1/02; H01J 29/04

[52] U.S. Cl. ..... 313/446; 313/456; 313/270; 313/37

[58] Field of Search ..... 313/446, 270, 313/337, 340, 451, 456, 37, 38; 445/34, 36

[56] References Cited

U.S. PATENT DOCUMENTS 5,402,035 3/1995 Lee ..... 313/270

FOREIGN PATENT DOCUMENTS 0534842A 3/1993 European Pat. Off. .

OTHER PUBLICATIONS

Japanese Patent Abstract, Publication No. 60105134, Publication Date Jun. 1985, p. 1.

Japanese Patent Abstract, Publication No. 60146426, Publication Date Aug. 1985, p. 1.

*Primary Examiner*—Sandra L. O'Shea
*Assistant Examiner*—Joseph Williams
*Attorney, Agent, or Firm*—Christie, Parker & Hale, LLP

[57] ABSTRACT

The present invention provides an electron gun cathode for CRTs including a sleeve, on which a cap having an electromagnetic radiation matter applied on its upper face, is fixed. A sleeve supporter that supports and is merged with this sleeve is inserted in the holder and, thus, securely fixed. Also, a number of through holes are formed in the circumference of the holder.

3 Claims, 2 Drawing Sheets

ELECTRON GUN CATHODE HOLDER WITH MANUFACTURING HOLES

BACKGROUND

The present invention relates to an electron gun cathode holder for cathode-ray tubes, and more particulary, to an electron cathode holder for CRTs in which the assembly of the electron gun cathode is easily accomplished and productivity is improved.

In the prior art CRTs, when electron beams are emitted from an electron gun (mounted to a neck portion), these electron beams strike phosphor pixels corresponding to a phosphor layer which is formed on the inside part of a panel, and produces a fixed image.

The electron beams are formed as a large number of electrons that are discharged from the electron gun cathode pass through the electrodes. FIG. 3 shows an example of the prior art electron gun cathode structure.

If the illustrated cathode structure is examined, a cap 12 can be seen attached to the upper opening of a sleeve 10. Electromagnetic radiation matter 14, such as ordinary carbonates, is applied to the top of the cap. A heater (not shown) is inserted in the inner part of the sleeve 10.

By a sleeve supporter 18 that is inserted inside a cylindrical holder 16, the sleeve 10 is supported and maintained in a fixed state.

In the prior art, the electron gun cathode for CRTs is constructed, the cap 12 is welded to the upper part of the sleeve 10, the sleeve 10 is inserted in the sleeve supporter 18, and the two are welded together in the lower part where they meet. The part of the sleeve supporter 18, that meshes with the holder 16 when inserted, is welded to the holder 16. Thus, the prior art electron gun cathode is constructed in a combined state.

In order to assemble the above prior-art electron gun cathode for CRTs, first the sleeve and sleeve supporter are merged together by welding, then the cap is welded to the upper part of the sleeve, and finally, the sleeve supporter is inserted in the holder and they are welded together.

But as each part needs to be welded in a certain order in this welding process, and as there are many steps in the process, productivity cannot be increased.

SUMMARY

The present invention has been made in an effort to solve the above problems.

It is an object of the present invention to provide an electron gun cathode holder for CRTs so that because it is a simple process when assembling the electron gun cathode for CRTs, productivity is improved.

To achieve the above objective, the present invention provides an electron gun cathode holder for CRTs including a sleeve, on which a cap having an electromagnetic radiation matter applied on its upper face, is fixed. A sleeve supporter that supports and is secured with this sleeve is inserted in the holder and, thus, securely fixed.

A number of through holes are formed in the circumference of the holder.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION

Preferred embodiments of the present invention will now be described in detail with reference to the accompanying drawings.

Figure 1:
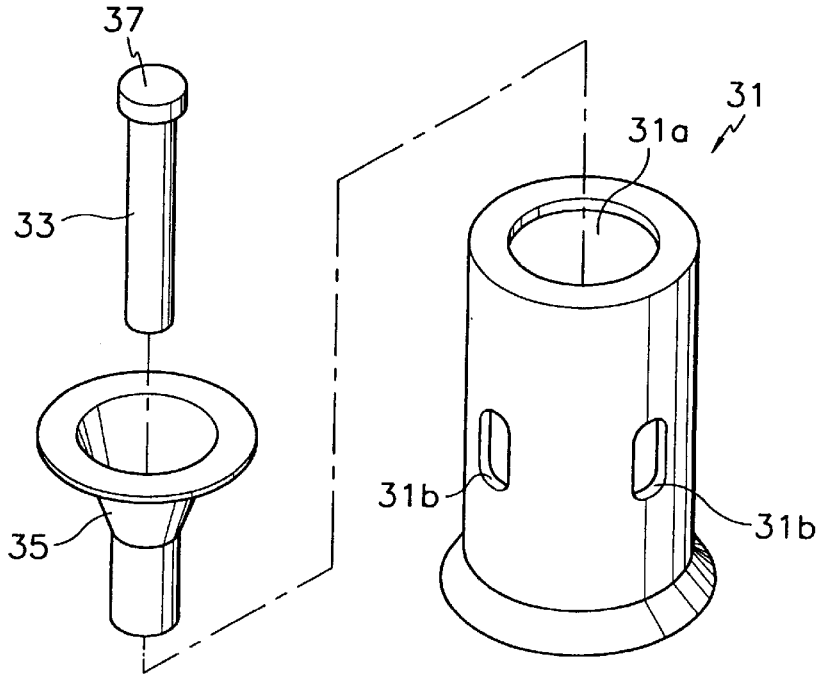
FIG. 1 is an exploded perspective view showing the structure of an electron gun cathode that is used by a cathode holder in accordance with a preferred embodiment of the present invention.
Figure 2:
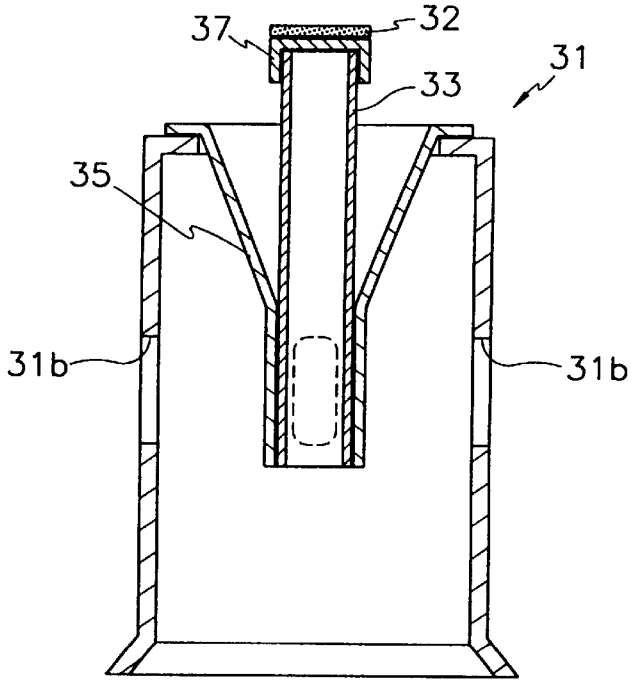
FIG. 2 is a sectional view of FIG. 1.
Figure 3:
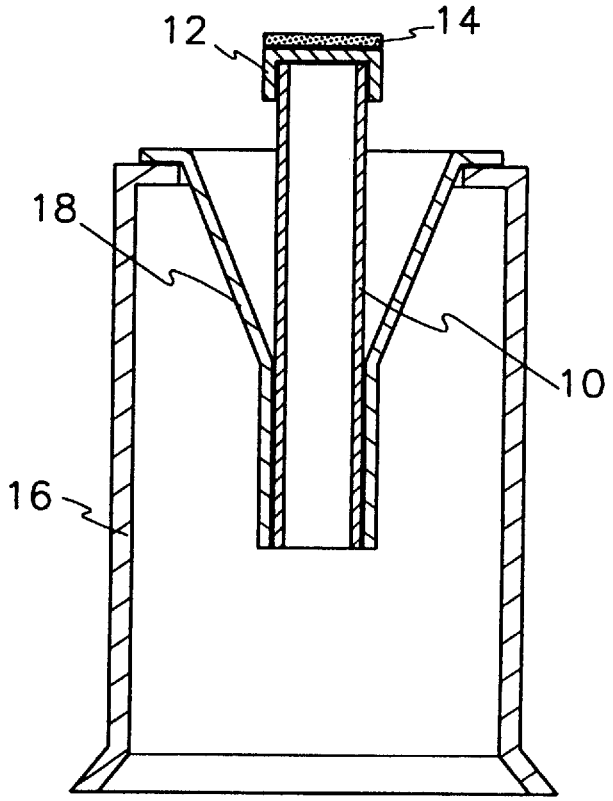
FIG. 3 PRIOR ART
FIG. 3 is a sectional view of the structure of the prior art electron gun cathode for CRTs.

FIG. 1 is an exploded perspective view of the structure of an electron gun cathode for CRTs in accordance with a preferred embodiment of the present invention. It illustrates how a sleeve and sleeve supporter are fixed in a cathode holder. FIG. 2 shows these in their fixed state.

As can be seen in the drawing, the basic shape of the cathode holder 31 is such that it is cylindrically with an opening at the bottom, and an insertion hole 31*a* is formed on the upper end, which is identical to that of the prior art.

In this cathode holder 31, the two parts that make up the electron gun cathode, a sleeve 33 and sleeve supporter 35 (which supports the sleeve 31), are secured and they are both inserted in the insertion hole 31*a* in this fixed state.

A cap 37, on which electromagnetic radiation matter 32 is applied on the upper surface, is fixed on the upper part of the sleeve 33. The sleeve supporter 35, in which the sleeve 33 is inserted, is hopper-shaped.

At this point, the sleeve 33 and sleeve supporter 35 are inserted in the insertion hole 31*a* with the lip of the sleeve supporter 35 being placed on the upper part of the cathode holder 31. As the fixing of the sleeve 33 with the sleeve supporter 35 is such that the lower part of the sleeve 33 is inserted in the inner part of the sleeve supporter 35 where it is stuck fast, both parts are maintained in a fixed state with each other and with the cathode holder 31.

In addition, formed on the circumference of the holder 31 are a number of through holes 31*b*, as can be seen in the drawing.

These through holes 31*b*, of which their use by laser beams for welding will be described below, are arranged equally distanced from each other at every 90 degrees on the circumference of the holder 31, therefore, four through holes 31*b* are formed. The location to which the through holes 31*b* are formed correspond to the area in which the sleeve 33 and sleeve supporter 35 are secured to each other, and so, they are on an equal level with this area.

The sleeve 33 and sleeve supporter 35, in this fixed state with the cathode holder 31, are kept secure by being welded together. The following describes the welding process.

In the fixed state, as shown in FIG. 2, the sleeve supporter 35 can be welded to the holder 31. At the same time, the laser beam can be projected from the outside of the holder 31 through the through holes 31*b* and to the area that the sleeve 33 and sleeve supporter 35 are merged to be welded together.

In addition, the cap 37 is also welded to the upper part of the sleeve 33 at this time.

So, unlike the prior art where the sleeve 33, sleeve supporter 35, and cathode holder 31 are all welded together separately and in a set order by use of the through holes 31*b*, all the welding operations can be performed simultaneously.

As described above, as several through holes are formed in the circumference of the electron gun cathode holder, when assembling the electron gun cathode, the sleeve, sleeve supporter, cathode holder, and cap can all be welded simultaneously.

As a result, when assembling the electron gun cathode of the present invention, steps in the assembly process are reduced and simplified, resulting in improved productivity.

While this invention has been described in connection with what is presently considered to be the most practical and preferred embodiment, it is to be understood that the invention is not limited to the disclosed embodiments, but, on the contrary, it is intended to cover various modifications and equivalent arrangements included within the spirit and scope of the claims.

What is claimed is:

1. An electron gun for CRTs, comprising:

a cathode holder;

a sleeve on which a cap, having an electromagnetic radiation matter applied to a top face thereof, is fixed; and a sleeve supporter supportably fixing the sleeve, said sleeve supporter being inserted and securely fixed in the cathode holder;

wherein the cathode holder is provided with at least two through holes on its circumference.

2. The electron gun for CRTs according to claim 1 wherein the through holes are formed at a level corresponding to where the sleeve and sleeve supporter are fixed together.

3. The electron gun for CRTs according to claim 2 wherein the through holes are formed at equal distances from one another.

* * * * *